United States Patent [19]

Hosaka

[11] Patent Number: 4,967,715

[45] Date of Patent: Nov. 6, 1990

[54] FUEL INJECTION CONTROL SYSTEM FOR AN AUTOMOTIVE ENGINE

[75] Inventor: Hiroshi Hosaka, Mitaka, Japan

[73] Assignee: Fuji Jukogyo Kabushiki Kaisha, Tokyo, Japan

[21] Appl. No.: 441,074

[22] Filed: Nov. 24, 1989

[30] Foreign Application Priority Data

Dec. 8, 1988 [JP] Japan ..... 63-310665

[51] Int. Cl.[5] ..... F02D 41/04

[52] U.S. Cl. ..... 123/494; 123/478; 364/431.05

[58] Field of Search ..... 123/478, 480, 486, 488, 123/494; 364/431.05, 510

[56] References Cited

U.S. PATENT DOCUMENTS 4,549,517 10/1985 Kamiyama ..... 123/494 X
4,705,001 11/1987 Danno et al. ..... 123/478 X
4,785,785 11/1988 Oba et al. ..... 123/494 X
4,911,133 3/1990 Sogawa ..... 123/494

FOREIGN PATENT DOCUMENTS 55-32913 3/1980 Japan .
60-43135 3/1985 Japan .
0130024 5/1989 Japan ..... 123/494

*Primary Examiner*—Willis R. Wolfe
*Attorney, Agent, or Firm*—Martin A. Farber

[57] ABSTRACT

A throttle opening degree of a throttle valve at a time when the throttle opening degree is used for determining quantity of fuel injected from an injector is estimated in accordance with coefficients and engine speed. The quantity of air induced in a cylinder of an engine is estimated by using the estimated throttle opening degree and equations based on various coefficients. A basic injection pulse width is calculated based on the estimated air quantity.

2 Claims, 5 Drawing Sheets

FUEL INJECTION CONTROL SYSTEM FOR AN AUTOMOTIVE ENGINE

BACKGROUND OF THE INVENTION

The present invention relates to a system for controlling the fuel injection of an automotive engine in dependence on a throttle opening degree and engine speed.

Japanese Patent Application Laid Open No. 55-32913 discloses a fuel injection system wherein a basic fuel injection pulse width Tp is calculated in dependence on throttle opening degree $\alpha$ and engine speed Ne. The basic pulse width Tp are stored in a table and are derived from the table for controlling the fuel injection during the operation of the engine.

However, since there is a space between the throttle valve and a cylinder of the engine, such as a chamber formed downstream of the throttle valve, changing of actual amount of induced air per engine cycle in response to the change of the throttle opening degree during the transient state is delayed. Accordingly, when the throttle valve is rapidly opened, the air-fuel mixture becomes rich. To the contrary, when the throttle valve is rapidly closed, the air-fuel mixture becomes lean.

Referring to FIG. 5 showing an increase in quantity of intake air at an acceleration of a vehicle, the basic fuel injection pulse width is determined dependent on air quantity $M_0$ which is calculated based on the opening degree $\alpha$ of a throttle and engine speed detected at a point A before an induction stroke of a cylinder, for example No. 1 cylinder. However, an actual air quantity $M_1$ at a point B after the induction stroke is larger than the quantity $M_0$ because of air induction at the induction stroke. Thus, there is a difference $\Delta M$ between the estimated quantity $M_0$ and the actual quantity $M_1$. As a result, the air-fuel ratio fluctuates at a transient state.

In a system disclosed in Japanese Patent Application Laid Open No. 60-43135, a necessary air flow is estimated dependent on the depressing degree of an accelerator pedal and engine speed. The fuel injection quantity is determined taking account of a first order lag of the actual air flow. Accordingly, fuel is gradually increased until the actual air flow coincides with the necessary air flow. However, the estimation of the air flow is inaccurate so that the air-fuel ratio of the fuel mixture fluctuates.

SUMMARY OF THE INVENTION

The object of the present invention is to provide a system for controlling the fuel injection where air-fuel mixture is prevented from becoming rich or lean during transient states and kept at an optimum air-fuel ratio.

In accordance with the present invention, the quantity of air induced in a cylinder of an engine is estimated by using equations based on various coefficients. The estimated air quantity is calculated based on estimated throttle valve opening degree so as to approximate the actual induced air quantity.

A basic injection pulse width is calculated based on the corrected induced air quantity.

The other objects and features of this invention will become understood from the following description with reference to the accompanying drawings.

DETAILED DESCRIPTION OF THE PREFERRED EMBODIMENT

Figure 1:
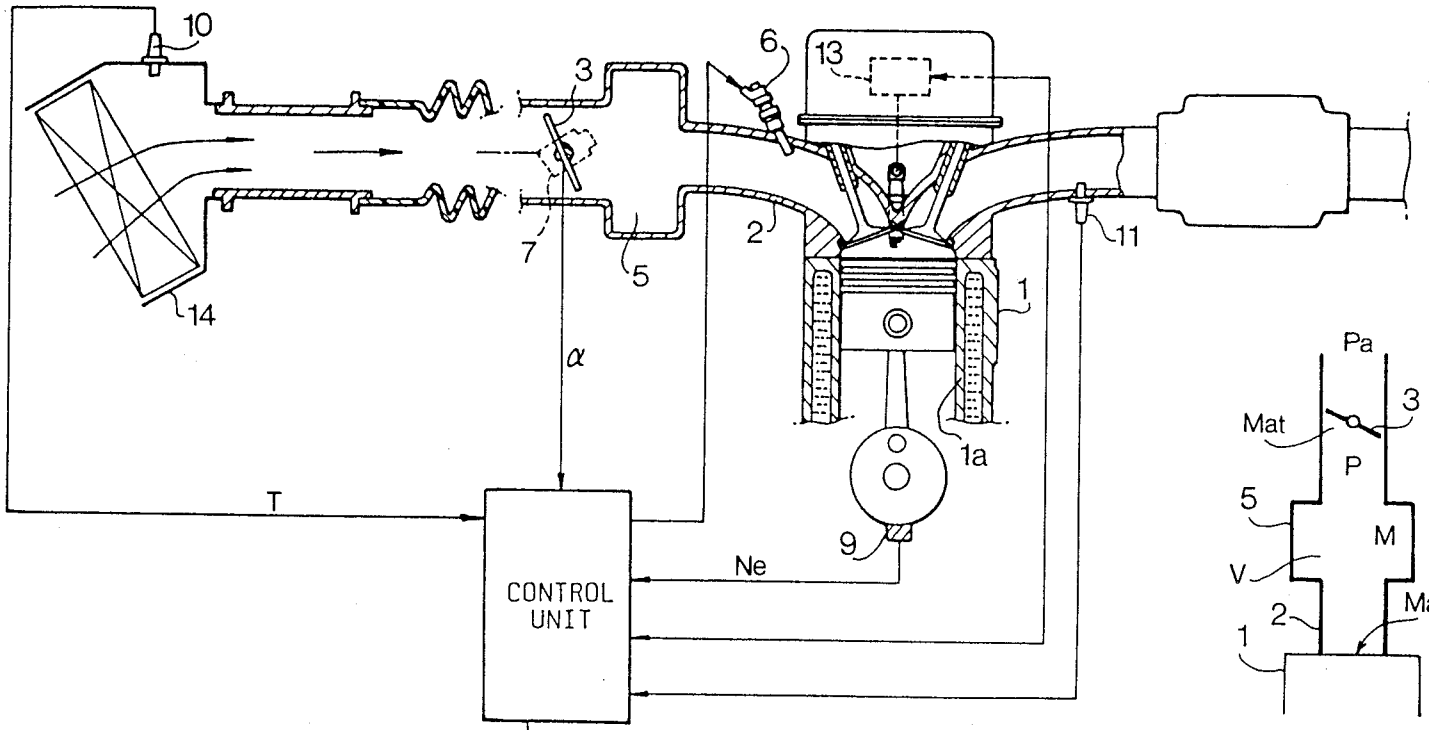
FIG. 1 is a schematic diagram showing a system according to the present invention.

Referring to FIG. 1, in an intake passage 2 of an engine 1, a throttle chamber 5 is provided downstream of a throttle valve 3 so as to absorb the pulsation of intake air. Multiple point fuel injectors 6 are provided in the intake passage 2 at adjacent positions of intake valves so as to supply fuel to cylinders 1a of the engine 1. A throttle position sensor 7 is provided on the throttle valve 3, and an engine speed sensor 9 is provided on the engine 1. An intake air temperature sensor 10 is provided on an air cleaner 14, and an $O_2$-sensor 11 is provided in an exhaust passage. Output signals of these sensors for detecting respective conditions are applied to a control unit 12 comprising a microcomputer to operate the fuel injectors 6 and ignition coils 13 for the cylinders of the engine.

Figure 2:
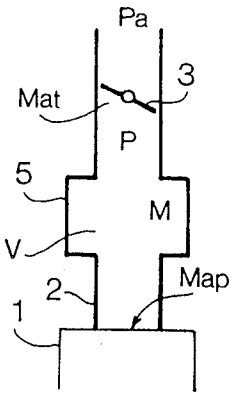
FIG. 2 is a schematic view of an intake system, for explaining various factors.

Quantity Map of the air induced in each cylinder can be estimated based on a model of the intake system as shown in FIG. 2.

In FIG. 2, Pa designates the atmospheric pressure, $\rho a$ is the density of the atmosphere, Map is the quantity of the air induced in the cylinder 1a of the engine 1, Mat is the quantity of the air passing the throttle valve 3, P is the pressure in the intake passage 2, V is the capacity of the intake passage 2, and M is the quantity of the air in the intake passage.

The quantity of accumulated air is represented as $$dM/dt = Mat - Map \quad (1)$$

The equation of state is $$PV = MRT \quad (2)$$

The quantity Map of the air induced in the cylinder is $$Map = (Ne \cdot D/2RT) \cdot \eta v \cdot P \quad (3)$$

The quantity Mat of the air passing the throttle valve is $$Mat = C \cdot A \cdot \psi \cdot \sqrt{Pa \cdot \rho a} \quad (4)$$

In this case, when $P/Pa > \{2/(k+1)\}^{k/(k-1)}$, $$\psi = \sqrt{2gk/(k-1)\,[(P/Pa)^{2/k} - (P/Pa)^{(k+1)/k}]}$$

and when $P/Pa < \{2/(k+1)\}^{k/(k-1)}$, $$\psi = \sqrt{2gk/(k+1)\ \{2/(k+1)\}^{2/(k-1)}}.$$

In the equations, Ne is the engine speed, D is the displacement of the cylinder, $\eta v$ is the volumetric efficiency, C is the coefficient for the quantity of air passing the throttle valve, R is the gas constant, k is the specific heat ratio, g is the gravitational acceleration, T is the intake air temperature, and A is the air passage sectional area. The volumetric efficiency $\eta v$, the coefficient C and the air passage sectional area A are functions of a throttle valve opening degree $\alpha$.

From the above equations, $$dP/dt=(RT/V)\cdot \mathrm{Mat}-(D/2V)\cdot Ne\cdot \eta v\cdot P \quad (5)$$

Discreting this equation $$P(k+1)=(RT/V)\cdot \Delta t\cdot \mathrm{Mat}(k)+\{(1-D/2V)\cdot Ne\cdot \eta v\Delta t\}\cdot P(k) \quad (6)$$

(where $\Delta t$ is a sampling cycle)

Thus, the intake air quantity Map is obtained by substituting the intake passage pressure P obtained by the equation (6) for the equation (3).

Figure 4A:
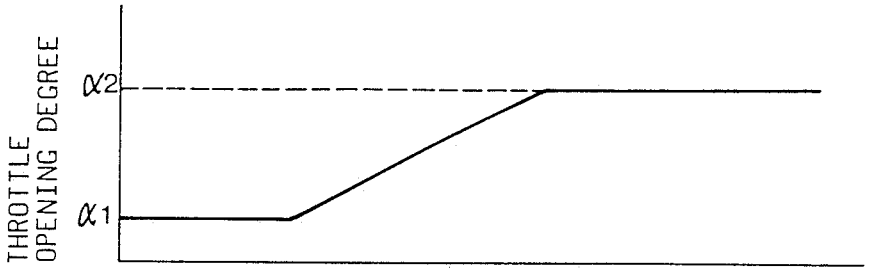
FIGS. 4a to 4c are graphs showing changes of throttle opening degree, induced air quantity and excessive air quantity, respectively.
Figure 4B:
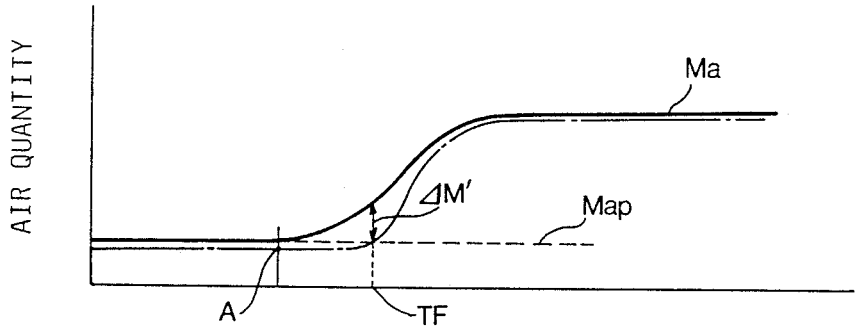

The air quantity Map shown by a dotted line in FIG. 4b is an estimation calculated before an induction stroke based on the signals from various sensors. In particular, during a transient state, the throttle valve opening degree and the engine speed vary even in the induction stroke.

Referring to FIGS. 4a and 4b, when the throttle valve is opened after the calculation of the intake air at the point A, actual quantity Ma increases. However, the estimated air quantity Map does not increase. Consequently, there is a difference $\Delta M'$ between the actual quantity Ma and the estimated quantity Map at a fuel injection time TF. Accordingly, it is necessary to correct the estimated air quantity Map in accordance with the throttle valve opening degree $\alpha$.

In accordance with the present invention, in order to correct the air quantity Map, the throttle valve opening degree after the calculation of the intake air quantity is estimated. The estimated throttle valve opening degree $\alpha'$ is calculated as follows.

$$\alpha'(k)=\alpha(k)+K1\{\alpha(k)-\alpha(k-1)\}+K2\{\alpha(k)-2\alpha(k-1)+\alpha(k-2)\} \quad (7)$$

where K1 and K2 are coefficients relative to the engine speed Ne. Namely, the estimated throttle valve opening degree $\alpha'$ is obtained in dependency on the throttle valve opening degree $\alpha(k)$ at present calculation, $\alpha(k-1)$ at the last calculation, and $\alpha(k-2)$ at the calculation before the last calculation, respectively. The volumetric efficiency $\eta v$, the coefficient C and the air passage sectional are a are obtained in dependency on the calculated estimated throttle valve opening degree $\alpha'(k)$. Thus, the induced air quantity is corrected. The dot-dash line of FIG. 4b shows the corrected induced air quantity.

A basic fuel injection pulse width Tp is calculated based on the corrected air quantity Map(k).

Figure 3:
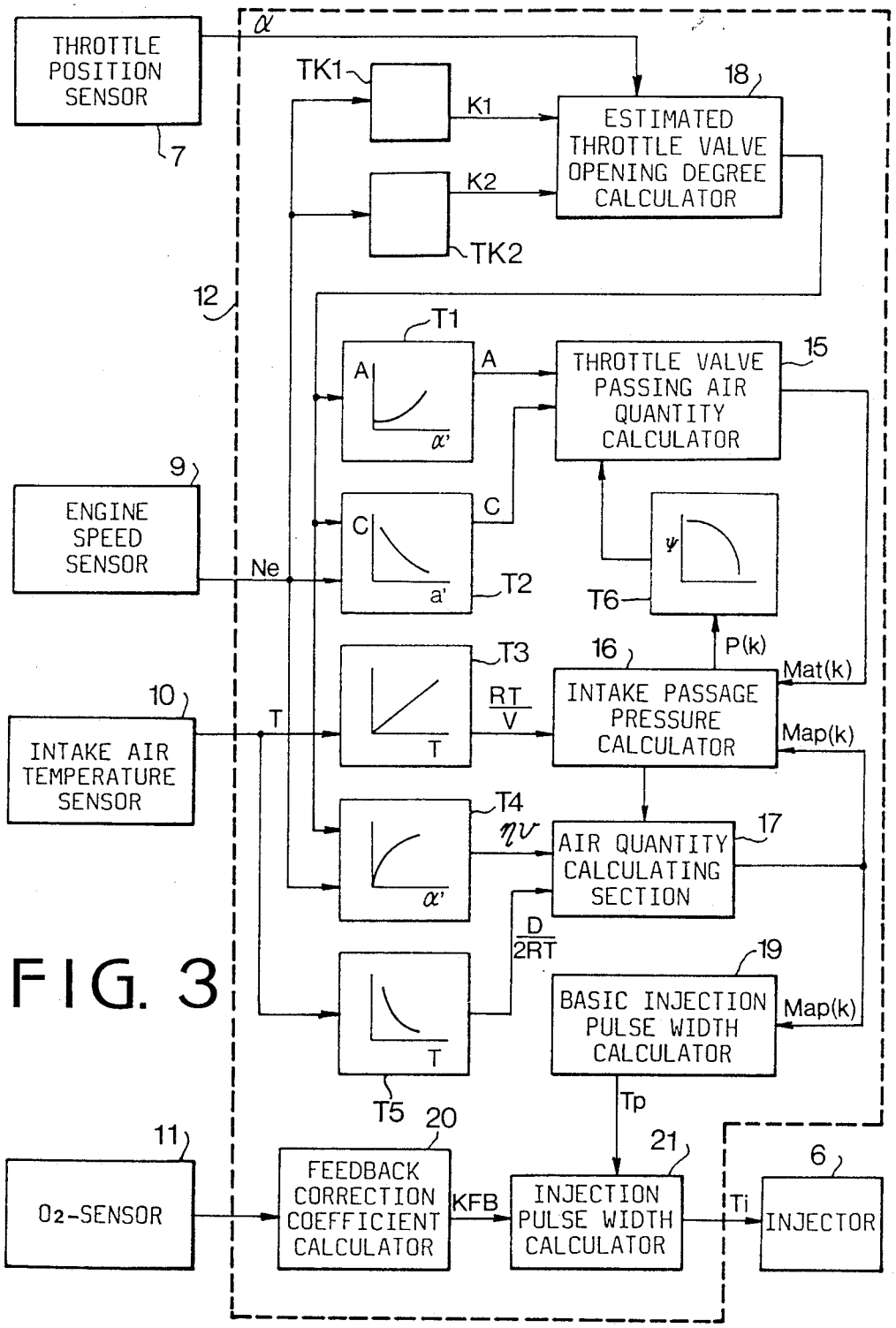
FIG. 3 is a block diagram showing a control unit of the present invention.

Referring to FIG. 3, the control unit 12 comprises a ROM which has tables $T_1$ to $T_6$ and tables $T_{K1}$ and $T_{K2}$. The tables $T_{K1}$ and $T_{K2}$ store a plurality of coefficients K1 and K2, respectively, for calculating the estimated throttle valve opening degree $\alpha'$ at an estimated throttle valve opening degree calculating in dependency on the engine speed Ne from the engine speed sensor 9. The coefficients K1 and K2 are applied to an estimated throttle valve opening degree calculator 18 to which the throttle valve opening degree $\alpha$is fed to make a calculation of the equation (7). The tables $T_1$ to $T_2$ store respective coefficients for the discreted model equations. Each coefficient is derived in accordance with engine operating conditions detected by respective sensors, namely, the engine speed Ne, and intake air temperature T and the estimated throttle opening degree $\alpha'$. The air passage sectional area A is derived from table $T_1$ in accordance with the estimated throttle valve opening degree $\alpha'$. In accordance with the throttle opening degree $\alpha'$ and the engine speed Ne, the coefficient C is derived from table $T_2$ and the coefficient $\eta v$ is derived from table $T_4$ in accordance with throttle opening degree $\alpha'$ and engine speed Ne. In accordance with the intake air temperature T, the coefficient RT/V is derived from table $T_3$ and the coefficient D/2RT is derived from table $T_5$. These coefficients are used as operators of the model equations at that time.

An intake passage pressure calculator 16 and a throttle valve passing air quantity calculator 15 are provided. The intake passage pressure calculator 16 is applied with coefficient RT/V and the throttle valve passing air quantity Mat(k) and the air quantity Map(k) and the intake passage P(k+1) is calculated by the following equation.

$$P(k+1)=P(k)+RT/V\cdot \Delta t\{\mathrm{Mat}(k)-\mathrm{Map}(k)\}$$

The value P(k) is applied to table $T_6$ to derive the coefficient $\Psi$ which is applied to the throttle valve passing air quantity calculator 15. The calculator 15 is applied with coefficients A and C, and calculates the air quantity Mat(k). The intake passage pressure P(k) and the coefficients $\eta v$ and D/2RT are applied to an air quantity calculating section 17 where the quantity of the air Map induced in the cylinder is calculated. The quantity Map is fed to a basic fuel injection pulse width calculator 19 for calculating a basic injection pulse width Tp.

The control unit 12 further has a feedback correction coefficient calculator 20 for calculating a feedback correction coefficient $K_{FB}$ based on an output voltage of the $O_2$ sensor 11, and has a fuel injection pulse width calculator 21 which is applied with the basic injection pulse width Tp and the correction coefficient $K_{FB}$ for correcting basic injection pulse width Tp in accordance with the coefficient $K_{FB}$ and calculates a fuel injection pulse width Ti.

In the basic fuel injection pulse width calculator 19, the basic fuel injection pulse width Tp is calculated in accordance with $$Tp=K/A/F_{ref}\times \mathrm{Map}(k)$$

where $A/F_{ref}$is a desired air fuel ratio and K is a coefficient. In the feedback correction coefficient calculator 20, the feedback correction coefficient $K_{FB}$is calculated in dependency on the output voltage of the $O_2$ sensor 11. The basic fuel injection pulse width Tp and the feedback correction coefficient $K_{FB}$ are applied to the injection pulse width calculator 21 where the injection pulse width Ti is calculated by the following equation.

$$Ti=Tp\cdot K_{FB}$$

The pulse width Ti is applied to the injectors 6 for injecting the fuel.

Figure 6:
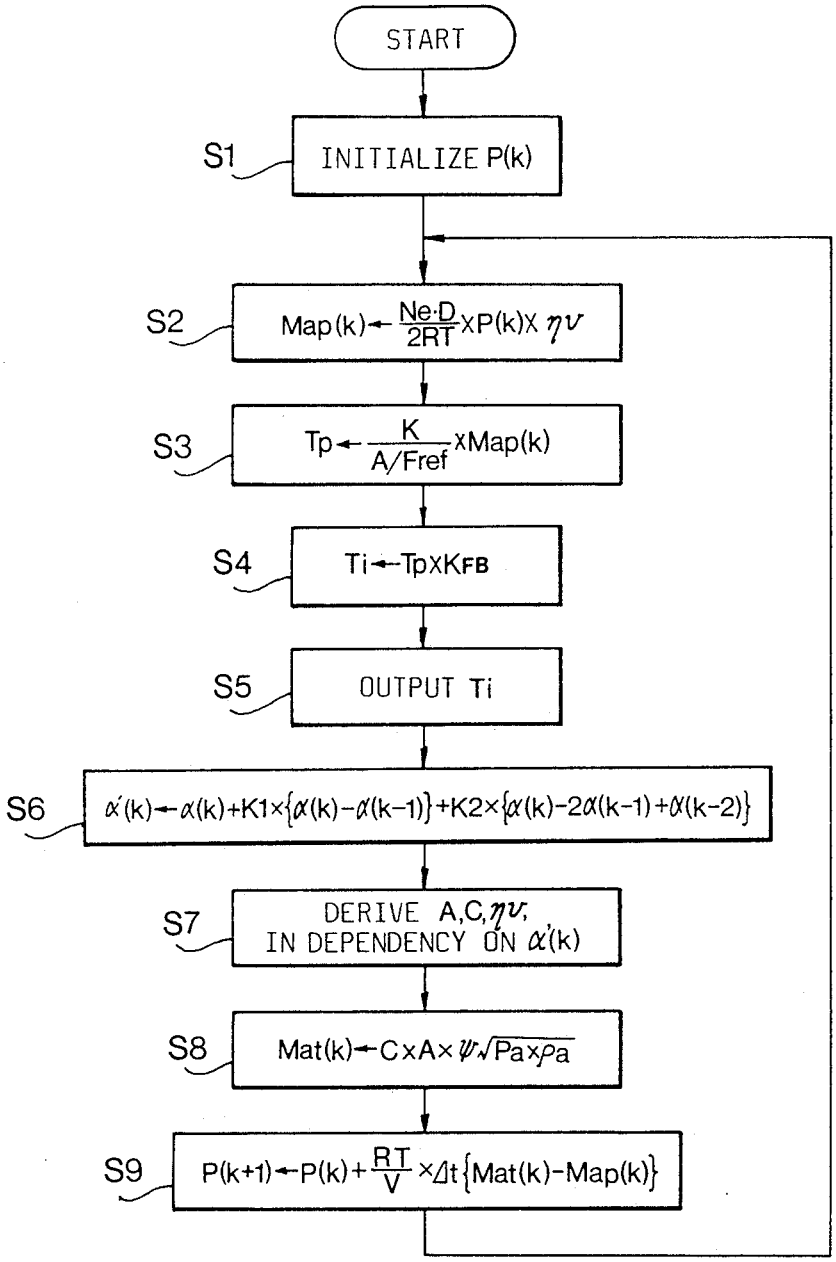
FIG. 6 is a flowchart explaining the operation of the system of the present invention.

The fuel injection pulse width Ti is calculated as shown in the flowchart of FIG. 6.

At a step S1, the intake passage pressure P(k) is initialized and the estimated air quantity Map(k) in the cylinder is calculated in accordance with the equation (3) in the air quantity calculating section 17 at a step S2. At a step S3, the basic fuel injection pulse width Tp is calculated in the basic fuel injection pulse width calculator 19. At a step S4, the pulse width is corrected with the feedback correction coefficient $K_{FB}$ obtained in the feedback correction coefficient calculator 20 to calculate the injection pulse width Ti. At a step S5, a signal corresponding to the pulse width Ti is applied to the injectors 6.

The program further proceeds to a step S6 where the estimated opening degree $\alpha'(k)$ of the throttle valve is calculated in accordance with the equation (7). The air passage sectional area A, the coefficient C for the air quantity passing through the throttle valve and the volumetric efficiency $\eta v$ are derived from the tables $T_1$, $T_2$ and $T_4$, respectively, at a step S7. At a step S8, the air quantity Mat(k) passing the throttle valve is calculated in dependency on the equation (6) using the sectional area A and the coefficient C derived at the step S7. At a step S9, the equation (6) is calculated to obtain the intake passage pressure P(k+1). Thereafter, the program returns to the step S2 where the air quantity Map is calculated based on the intake passage pressure P(k+1) obtained at the step S9. Thus, the optimum quantity of fuel is obtained as the program is repeated.

Figure 4C:
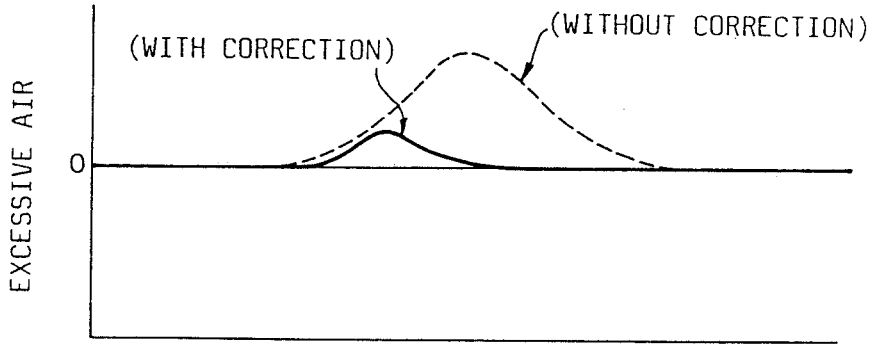
Figure 5:
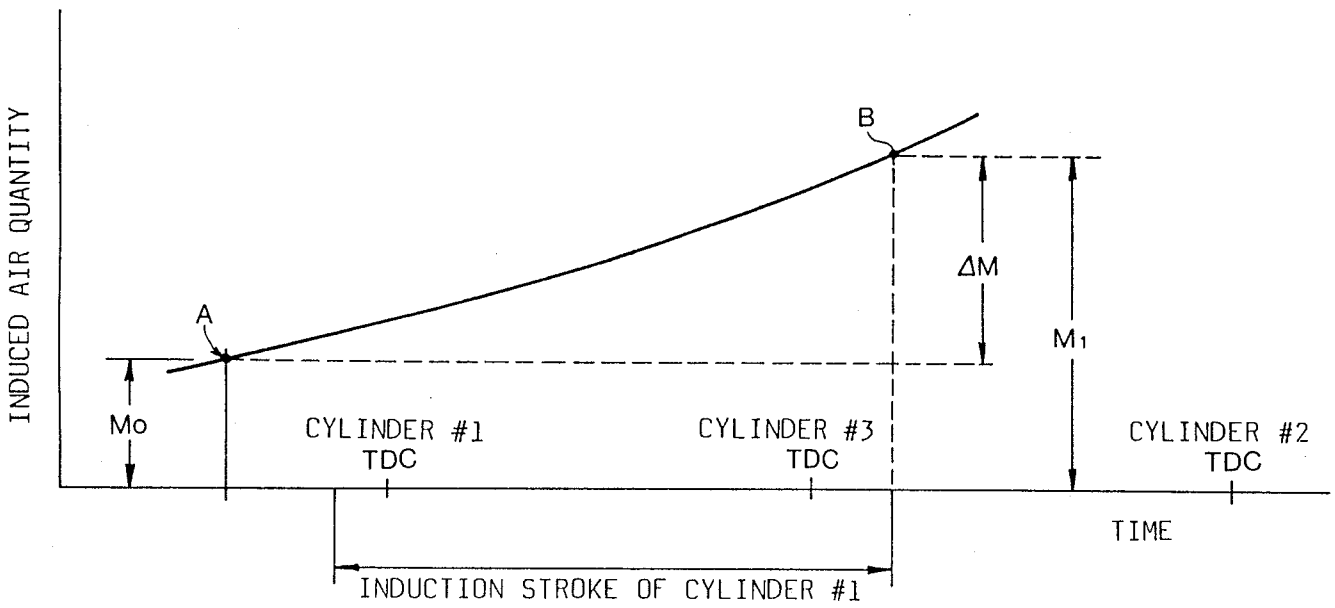
FIG. 5 is a graph showing characteristics of the induced air quantity.

The operation of the present invention is explained hereinafter with reference to FIGS. 4*a* to 4*c*.

In a transient state, the throttle valve opening degree increases from $\alpha_1$ to $\alpha_2$ shown in FIG. 4*a*, the actual induced air quantity Ma shown by a solid line in FIG. 4*b* increases accordingly. The estimated air quantity Map shown by a dotted line does not increase, so that there is a difference $\Delta M'$ between the actual air quantity Ma and the estimated air quantity Map at the fuel injection time TF. The estimated air quantity Map is calculated based on the estimated throttle opening degree $\alpha'$ shown by a dot-dash line, so that the air quantity Map increases approximately with the actual air quantity Ma. Thus, the air quantity Map is corrected to a value corresponding to the opening degree of the throttle valve 3.

Therefore, an optimum quantity of fuel based on the air quantity Map (k) is injected through the injectors 6. As a result, excess of air over the quantity of fuel slightly exists only at the start of the acceleration as shown in FIG. 4*c*, so that the air-fuel ratio is prevented from becoming excessively lean. Similarly, the air-fuel ratio is kept from becoming over-rich when the vehicle is decelerated.

In accordance with the present invention, the opening degree of the throttle valve at a transient state is estimated so that the quantity of the air estimated by the model equations approximates the actual quantity of induced air. Accordingly, an optimum air-fuel ratio is provided for preventing air-fuel mixture from becoming rich or lean, thereby improving driveability of the automobile. In addition, concentrations of NOx and CO in the emissions can be reduced.

While the presently preferred embodiment of the present invention has been shown and described, it is to be understood that this disclosure is for the purpose of illustration and that various changes and modifications may be made without departing from scope of the invention as set forth in the appended claims.

What is claimed is:

1. A system for controlling fuel injection of an engine for a motor vehicle having an intake passage, a throttle valve provided in the intake passage, and a fuel injector, the system comprising:

an engine speed sensor for producing an engine speed signal dependent on speed of the engine;

a throttle position sensor for producing a throttle opening degree signal dependent on opening degree of the throttle valve;

storing means for storing various coefficients which are arranged in accordance with the engine speed signal and the throttle opening degree signal;

estimating means for estimating a throttle opening degree at a time when the estimated throttle opening degree is used for determining quantity of fuel injected from the injector;

first calculator means for calculating a quantity of induced air, using coefficients derived from the storing means in accordance with the engine speed signal and the estimated throttle opening degree; and second calculator means for producing a basic injection pulse width signal in accordance with said corrected induced air quantity.

2. The system according to claim 1, wherein: the estimating means comprises memory means storing coefficients for estimating the throttle opening degree in accordance with engine speed.

* * * * *